US010461423B2

(12) United States Patent
Chou et al.

(10) Patent No.: US 10,461,423 B2
(45) Date of Patent: Oct. 29, 2019

(54) MULTI-FREQUENCY ANTENNA

(71) Applicant: UNICTRON TECHNOLOGIES CORPORATION, Hsin-Chu (TW)

(72) Inventors: Chih-Shen Chou, Hsin-Chu (TW); Tsung-Shou Yeh, Hsin-Chu (TW); Jer-Yeu Kuo, Hsin-Chu (TW); Hsiang-Cheng Yang, Hsin-Chu (TW)

(73) Assignee: Unictron Technologies Corporation, Hsin-Chu (TW)

( * ) Notice: Subject to any disclaimer, the term of this patent is extended or adjusted under 35 U.S.C. 154(b) by 41 days.

(21) Appl. No.: 15/696,544

(22) Filed: Sep. 6, 2017

(65) Prior Publication Data

US 2018/0090839 A1 Mar. 29, 2018

(30) Foreign Application Priority Data

Sep. 29, 2016 (TW) ..... 105214817 U

(51) Int. Cl.

| | |
|---|---|
| ***H01Q 5/30*** | (2015.01) |
| ***H01Q 1/52*** | (2006.01) |
| ***H01Q 1/24*** | (2006.01) |
| ***H01Q 5/321*** | (2015.01) |
| *H01Q 9/04* | (2006.01) |
| *H01Q 9/28* | (2006.01) |
| *H01Q 9/42* | (2006.01) |
| *H01Q 5/371* | (2015.01) |

(52) U.S. Cl.

CPC ..... *H01Q 5/30* (2015.01); *H01Q 1/24* (2013.01); *H01Q 1/52* (2013.01); *H01Q 1/521* (2013.01); *H01Q 5/321* (2015.01); *H01Q 5/371* (2015.01); *H01Q 9/0421* (2013.01); *H01Q 9/285* (2013.01); *H01Q 9/42* (2013.01)

(58) Field of Classification Search

CPC ..... H01Q 5/30; H01Q 1/521; H01Q 1/52; H01Q 1/24

USPC ..... 343/850

See application file for complete search history.

(56) References Cited

U.S. PATENT DOCUMENTS 7,136,020 B2 * 11/2006 Yamaki ..... H01Q 9/285 343/702

* cited by examiner

*Primary Examiner* — Hai V Tran

(74) *Attorney, Agent, or Firm* — Winston Hsu

(57) ABSTRACT

A multi-frequency antenna comprises a substrate disposed on a clearance area of a circuit board, and a first resonance unit and a second resonance unit located on the surface of the substrate or within the substrate. The first resonance unit is connected to a signal feeding terminal of the circuit board and connected to the second resonance unit via a first filtering element. The first resonance unit forms the first resonance frequency of the multi-frequency antenna, and the first resonance unit, the first filtering element, and the second resonance unit all together form the second resonant frequency. The first filtering element shows a high impedance towards the signal with the first resonant frequency and a low impedance towards the signal with the second resonant frequency. Thus, an antenna with multiple resonant frequencies can be obtained. The material and manufacturing costs of the multi-frequency antenna can thereby be reduced.

12 Claims, 14 Drawing Sheets

MULTI-FREQUENCY ANTENNA

REFERENCE TO RELATED APPLICATIONS

This non-provisional application claims priority under 35 U.S.C. § 119(a) on Taiwan Patent Application No. 105214817 filed Sep. 29, 2016, the entire contents of which are incorporated herein by reference.

FIELD OF THE INVENTION

The invention relates to a multi-frequency antenna for transmitting or receiving signals with different frequencies, and its advantage is to reduce the size and production costs of multi-frequency antennae.

BACKGROUND

Noting the continued fast progression of wireless communication technologies, wireless communication products are increasingly widely used in our daily lives. The antenna is one of the most important devices for wireless communication products. In general, the antenna may occupy considerable space in wireless communication products. Thus, the reduction of antenna size in order to minimize the size of communication products is a large issue and of great concern.

A microstrip antenna usually refers to an antenna fabricated through the use of microstrip techniques. Microstrip antennae have attracted a great deal of attention due to their plane structure, low cost, ease to be mass produced, and integrated with active components or circuit boards. Thus, microstrip antennae have been widely used in many portable devices that require wireless communication capability, such as mobile phones, smart phones, tablet computers, notebook computers, GPS (Global Positioning System) units, and RFID devices. Despite the many advantages of microstrip antennae, they have several basic disadvantages, such as narrow bandwidth, low gain, and relatively large size.

With the aim of reducing the size and weight of portable computers, the PIFA (Planar Inverted F Antenna) or monopole antenna can be set up on the circuit board of the portable device. However, because of rapid developments in the wireless communication industry, most mobile devices are installed with communication modules that must transmit or receive signals at various frequency bands. Therefore, antennae with multiple resonance frequencies are essential elements in most mobile devices. To design a monopole or PIFA antenna with multiple resonance frequencies, the area or space of a circuit board needs to be large. In actual application, in order to meet the requirement of at least a quarter of the wavelength, the dimensions of the monopole or PIFA antenna cannot be further reduced.

SUMMARY

Therefore, the main objective of the present invention is to provide a multi-frequency antenna that comprises one or more filtering elements connected between two resonance units of the antenna, thereby allowing the antenna to generate two or more resonant frequencies. In one embodiment, the resonance unit may be a resonant segment and the antenna may be a chip antenna.

In order to achieve the above objects, the present invention provides a multi-frequency antenna that comprises a circuit board, at least one substrate, a first resonance unit, a first filtering element, and a second resonance unit. The circuit board includes a clearance area and at least one signal feeding terminal, and the substrate is disposed within the clearance area. The first resonance unit is connected to the signal feeding terminal, with part or all of the first resonance unit located on the surface of the substrate or within the substrate. The first filtering element is located between the first resonance unit and the second resonance unit, with part or all of the second resonance unit disposed on the surface of or within the substrate. The first resonance unit forms the first resonant frequency of the multi-frequency antenna. The first resonance unit, the first filtering element, and the second resonance unit jointly form the second resonant frequency of the multi-frequency antenna, wherein the second resonant frequency is lower than the first resonant frequency. The first filtering element shows a high impedance towards the electronic signal with the first resonant frequency to prevent the first resonant frequency signal from entering the second resonance unit. Further, the first filtering element shows a low impedance towards the second resonant frequency signal, with the second resonant frequency signal being capable of passing through the first filtering element.

BRIEF DESCRIPTION OF THE DRAWINGS

The structure as well as preferred modes of use, further objects, and advantages of this invention will be best understood by referring to the following detailed descriptions of illustrated embodiments in conjunction with the accompanying drawings, in which.

DETAILED DESCRIPTION OF THE PREFERRED EMBODIMENTS

Figure 1:
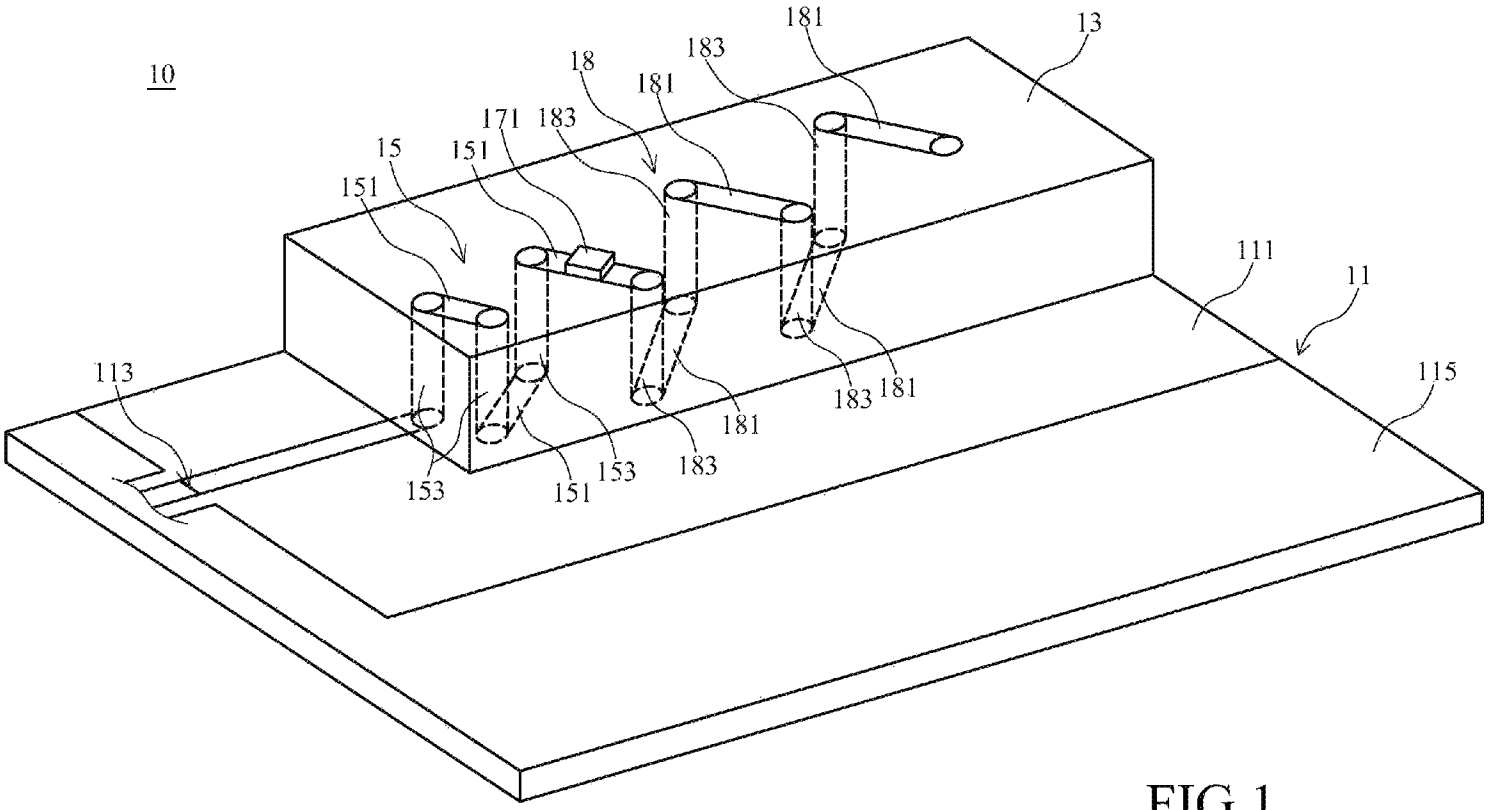
FIG. 1 is a perspective view of a multi-frequency antenna according to an embodiment of the invention.

FIG. 1 is a perspective view of a multi-frequency antenna according to an embodiment of the invention. The multi-frequency antenna 10 comprises a circuit board 11, at least one substrate 13, a first resonance unit 15, a first filtering element 171, and a second resonance unit 18. The circuit board 11 comprises a clearance area 111 and at least one signal feeding terminal 113, and the substrate 13 is disposed within the clearance area 111 of the circuit board 11, wherein the clearance area is a region on the substrate without ground plane.

One end of the first resonance unit 15 is connected to the signal feeding terminal 113, and the other end of the first resonance unit 15 is connected to the first filtering element 171. Partial or all of the first resonance unit 15 may be located on the surface of the substrate 13 or within the substrate 13. For example, portion of the first resonance unit 15 is located on the surface of the substrate 13, portion of the first resonance unit 15 is located within the clearance area 111 of the circuit board 11 to connect with the signal feeding terminal 113 and portion of the first resonance unit 15 is embedded within the substrate 13.

The second resonance unit 18 is connected to the first filtering element 171, and thus the first filtering element 171 is located between the first resonance unit 15 and the second resonance unit 18. Part or all of the second resonance unit 18 may be located on the surface of the substrate 13 or within the substrate 13.

The first resonance unit 15 is used to form the first resonant frequency f1 of the multi-frequency antenna 10, and the first resonance unit 15, the first filtering element 171, and the second resonance unit 18 jointly form the second resonant frequency f2 of the multi-frequency antenna 10. The second resonant frequency f2 is lower than the first resonant frequency f1.

More specifically, the first filtering element 171 shows a high impedance towards the electronic signal with first resonant frequency f1, and the first resonant frequency signal f1 is isolated from the second resonance unit 18 without transmitting to the second resonance unit 18. Furthermore, the first filtering element 171 shows a low impedance towards the signal with the second resonant frequency f2, and thus the second resonant frequency signal f2 can pass through the first filtering element 171.

In practical application, a suitable first filtering element 171 may be selected based on the first resonant frequency f1 and the second resonant frequency f2 of the multi-frequency antenna 10. For example, the first filtering element 171 may comprise at least one inductor or a resonance circuit consisting of inductors and capacitors. Further, because the second resonant frequency f2 is jointly formed by the first resonance unit 15, the first filtering element 171, and the second resonance unit 18, the frequency of the second resonant frequency f2 will change based on the replacement of the first filtering element 171.

Further, the first resonance unit 15 and the second resonance unit 18 may comprise a plurality of conducting segments, such as conducting wires, connecting units, conducting planes, or curved conducting surfaces. More specifically, the conducting wire, the conducting plane, or the curved conducting surface is disposed on the surface of the substrate 13, within the substrate 13, or within the clearance area 111 of the circuit board 11, and the connecting unit penetrates through part or all of the substrate 13 in order to connect with the conducting wire, the conducting plane, or the curved conducting surface.

In this embodiment of the invention, the first resonance unit 15 may comprise a plurality of first conducting layers 151, such as conducting wires, and a plurality of first connecting units 153. Each first conducting layer 151 may be respectively disposed on different planes or surfaces of the substrate 13. For example, the first conducting layers 151 are disposed on the top surface and/or the bottom surface of the substrate 13. The first connecting units 153 that penetrate through part or all of the substrate 13 are connected with first conducting layers 151 disposed on different planes or surfaces of the substrate 13. Similarly, the second resonance unit 18 may also comprise a plurality of second conducting layers 181, such as conducting wires, and a plurality of second connecting units 183. Each second conducting layer 181 may be disposed on different planes or surfaces of the substrate 13. For example, the second conducting layers 181 are disposed on the top surface and/or the bottom surface of the substrate 13. The second connecting units 183 that penetrate through part or all of the substrate 13 are connected to the second conducting layers 151 disposed on different planes or surfaces of the substrate 13.

Figure 2:
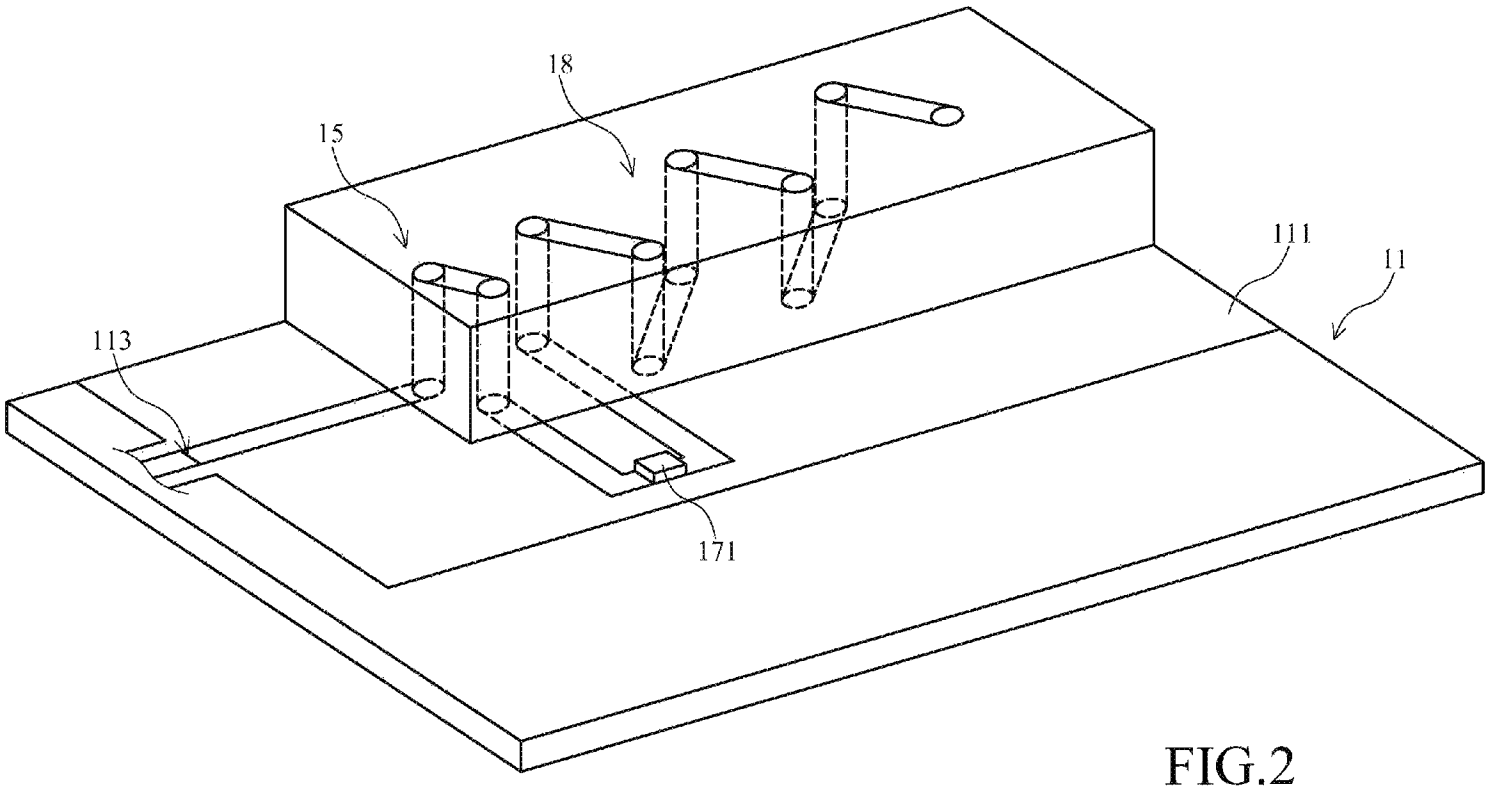
FIG. 2 is a perspective view of a multi-frequency antenna according to another embodiment of the invention.

In this embodiment of the invention, the first filtering element 171 is disposed on the surface of the substrate 13, as shown in FIG. 1. In another embodiment of the invention, the first filtering element 171 may be disposed within the clearance area 111 of the circuit board 11, and the first resonance unit 15 and the second resonance unit 18 are connected to the first filtering element 171 within the clearance area 111 by the conducting wires within the clearance area 111, as shown in FIG. 2.

Figure 3:
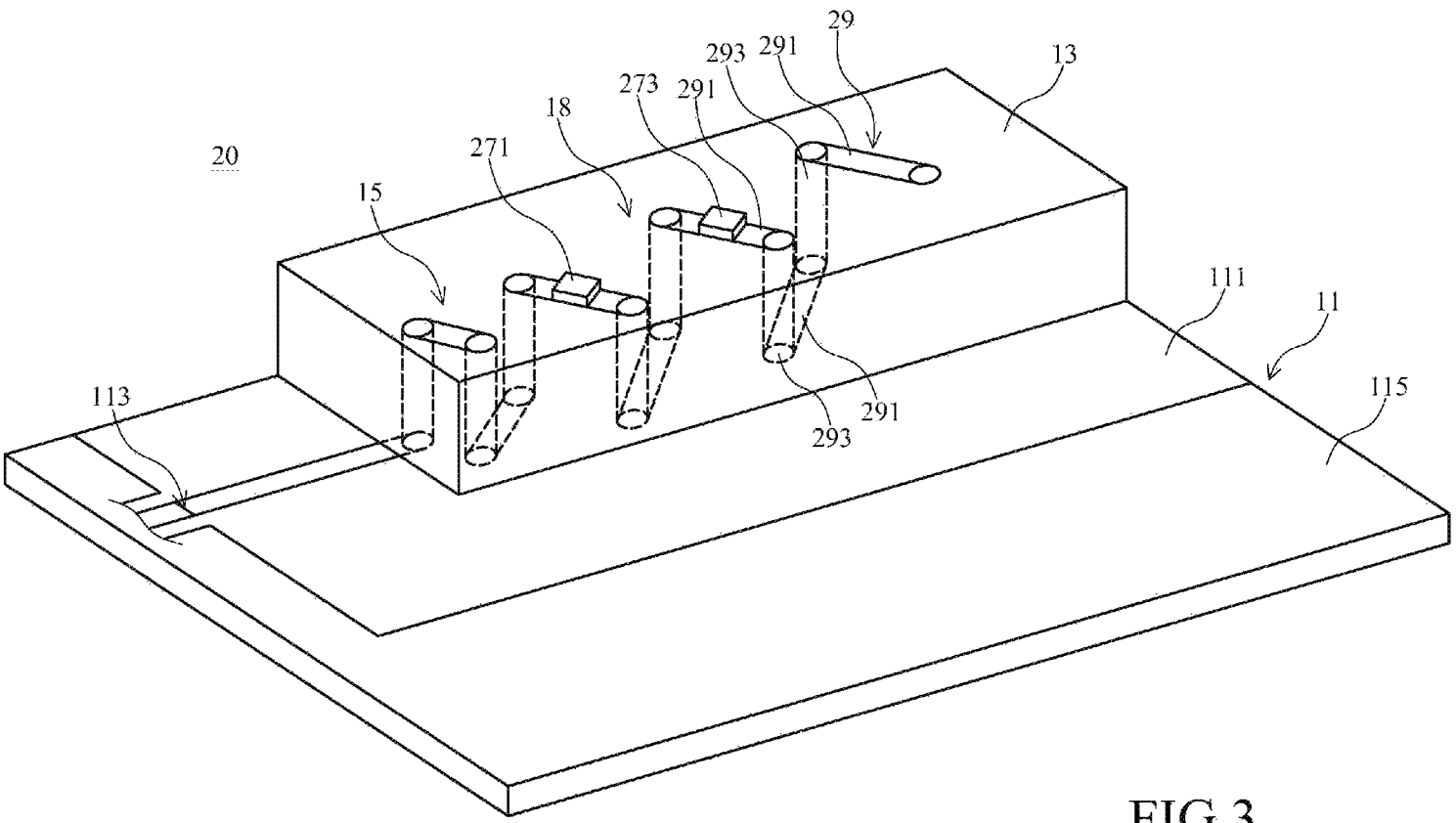
FIG. 3 is a perspective view of a multi-frequency antenna according to another embodiment of the invention.

FIG. 3 is a perspective view of a multi-frequency antenna according to another embodiment of the invention. The multi-frequency antenna 20 comprises a circuit board 11, at least one substrate 13, a first resonance unit 15, a first filtering element 271, a second resonance unit 18, a second filtering element 273, and a third resonance unit 29. The circuit board 11 comprises a clearance area 111 and at least one signal feeding terminal 113, and the substrate 13 is disposed within the clearance area 111 of the circuit board 11.

One end of the first resonance unit 15 is connected to the signal feeding terminal 113, and the other end of the first resonance unit 15 is connected to one end of the first filtering element 271, wherein part or all of the first resonance unit 15 is located on the surface of the substrate 13 or within the substrate 13. For example, part of the first resonance unit 15 is disposed on the surface and interior of the substrate 13, and part of the first resonance unit 15 is disposed within the clearance area 111 of the circuit board 11 in order to connect to the signal feeding terminal 113.

The second resonance unit 18 is connected to the other end of the first filtering element 271, and thus the first filtering element 171 is disposed between the first resonance unit 15 and the second resonance unit 18, wherein part or all of the second resonance unit 18 is disposed on the surface of the substrate 13 or within the substrate 13.

One end of the second filtering element 273 is connected to the second resonance unit 18, and the third resonance unit 29 is connected to the other end of the second filtering element 273. Thus, the second filtering element 273 is disposed between the second resonance unit 18 and the third resonance unit 29, and part or all of the third resonance unit 29 is disposed on the surface of or within the substrate 13. The first filtering element 271 and the second filtering element 273 may respectively comprise at least one inductor or a resonant circuit consisting of capacitors and inductors.

The first resonance unit 15 forms the first resonant frequency f1 of the multi-frequency antenna 20, and the first resonance unit 15, the first filtering element 271, and the second resonance unit 18 jointly form the second resonant frequency f2 of the multi-frequency antenna 20, wherein the second resonant frequency f2 is lower than the first resonant frequency f1. Further, the first resonance unit 15, the first filtering element 271, the second resonance unit 18, the second filtering element 273, and the third resonance unit 29 jointly form a third resonant frequency f3 of the multi-frequency antenna 20, and the third resonant frequency f3 is lower than the second resonant frequency f2.

More specifically, the first filtering element 271 shows a high impedance towards the signal with the first resonant frequency f1 to isolate the first resonant frequency signal f1 from the second resonance unit 18. Thus, the signal with the first resonant frequency f1 is unable to be transmitted to the second resonance unit 18. Further, the first filtering element 271 shows a low impedance towards the signals with the second resonant frequency f2 and the third resonant frequency f3. Thus, the second resonant frequency signal f2 and the third resonant frequency signal f3 can pass through the first filtering element 271.

The second filtering element 273 shows a high impedance towards signal with the second resonant frequency f2 to isolate the second resonant frequency signal f2 from the third resonance unit 29. Thus, the second resonant frequency signal f2 is unable to be transmitted to the third resonance unit 29. Furthermore, the second filtering element 273 shows a low impedance towards the signal with the third resonant frequency f3, and thus the third resonant frequency signal f3 can pass through the second filtering element 273.

In one embodiment of the invention, the third resonance unit 29 comprises a plurality of conducting segments, such as conducting wires, connecting units, conducting planes, or curved conducting surfaces. In this embodiment of the invention, the third resonance unit 29 comprises a plurality of third conducting layers 291, such as conducting wires, and a plurality of third connecting units 293, wherein each third conducting layer 291 is disposed on different planes or surfaces of the substrate 13. For example, each third conducting layer 291 is disposed on the top or bottom surface of the substrate 13. The third connecting unit 293 passes through part or all of the substrate 13 in order to connect to the third conducting layers 291 disposed on different planes or surfaces of the substrate 13.

Figure 4:
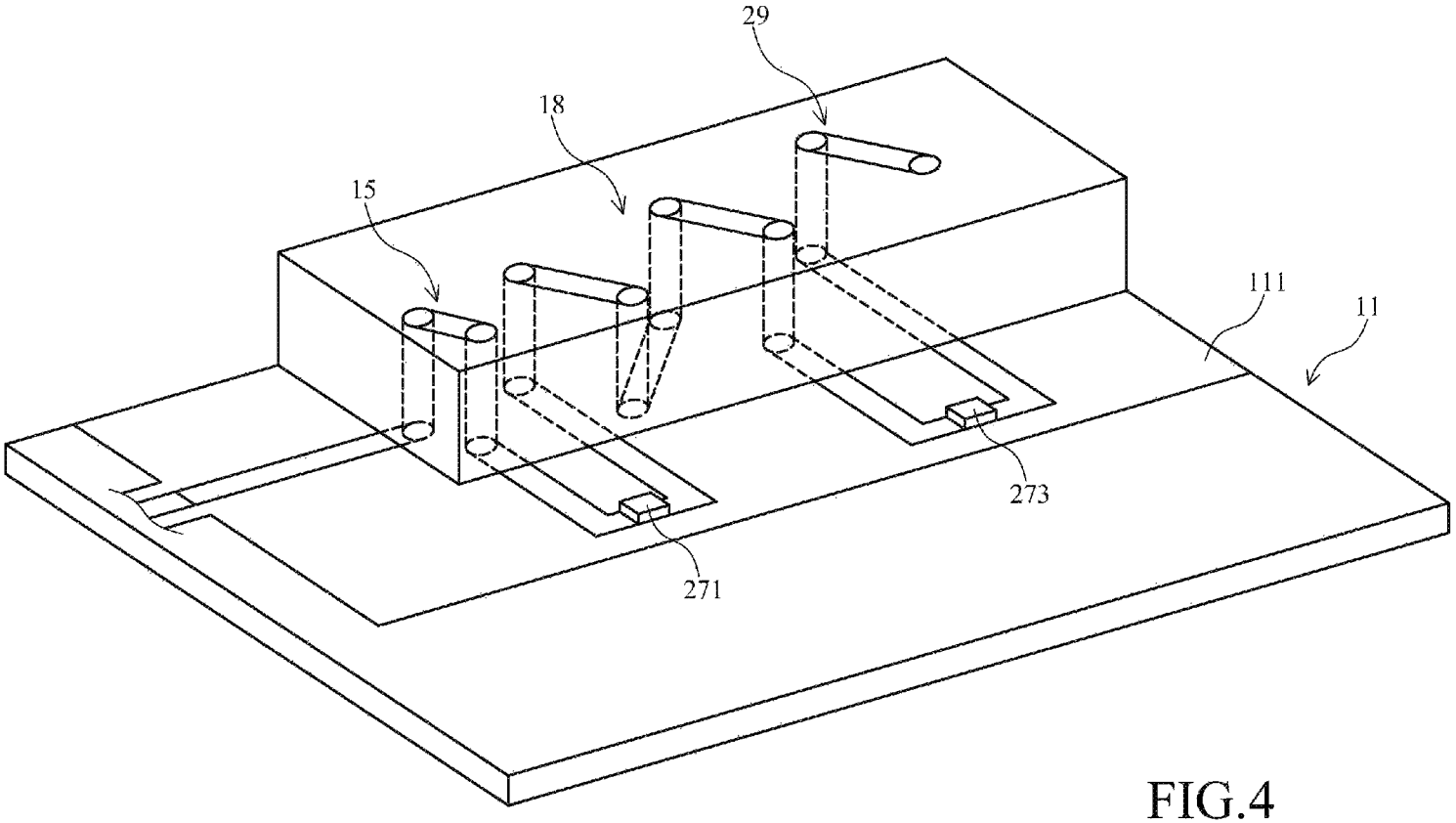
FIG. 4 is a perspective view of a multi-frequency antenna according to another embodiment of the invention.

In this embodiment of the invention, the first filtering element 271 and the second filtering element 273 are disposed on the surface of the substrate 13, as shown in FIG. 3. In another embodiment of the invention, the first filtering element 271 and the second filtering element 273 may be disposed within the clearance area 111 of the circuit board 11, and the first resonance unit 15 and the second resonance unit 18 are connected to the first filtering element 271 within the clearance area 111 via the conducting wires within the clearance area 111. The second resonance unit 18 and the third resonance unit 29 are connected to the second filtering element 273 within the clearance area 111 via the conducting wires within the clearance area 111, as shown in FIG. 4. In another embodiment of the invention, the first filtering element 271 may be disposed on the surface of the substrate 13, and the second filtering element 273 may be disposed within the clearance area 111. In another embodiment of the invention, the second filtering element 273 may be disposed on the surface of the substrate 13, and the first filtering element 271 may be disposed within the clearance area 111.

Figure 5:
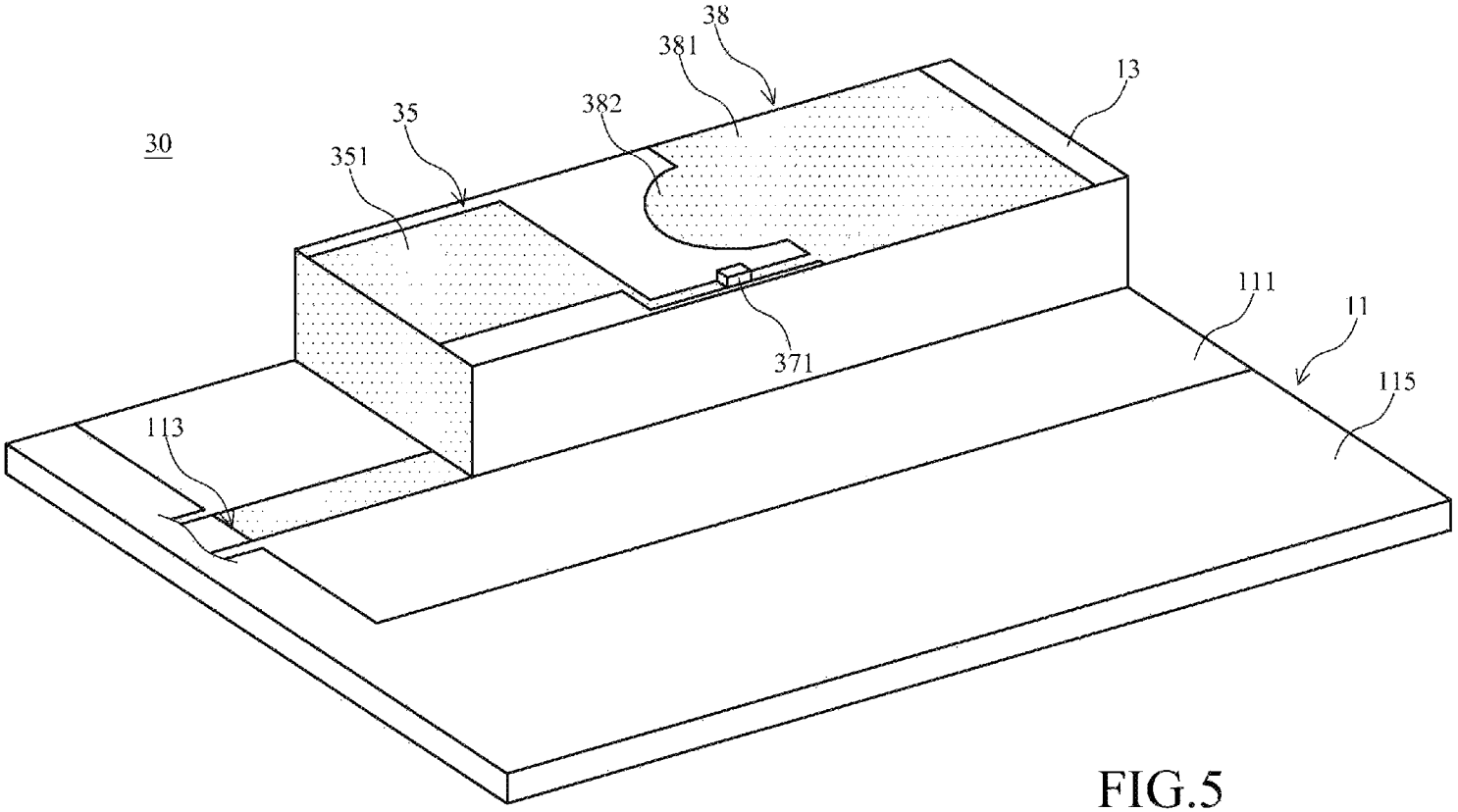
FIG. 5 is a perspective view of a multi-frequency antenna according to another embodiment of the invention.

FIG. 5 is a perspective view of a multi-frequency antenna according to another embodiment of the invention. The multi-frequency antenna 30 comprises a circuit board 11, at least one substrate 13, a first resonance unit 35, a first filtering element 371, and a second resonance unit 38. The circuit board 11 comprises a clearance area 111 and at least one signal feeding terminal 113, and the substrate 13 is disposed within the clearance area 111 of the circuit board 11.

The first resonance unit 35 is connected to the signal feeding terminal 113, and part or all of the first resonance unit 35 is disposed on the surface of or within the substrate 13. For example, part of the first resonance unit 35 is disposed on the surface of the substrate 13 or within the substrate 13, and part of the first resonance unit 35 is disposed within the clearance area 111 of the circuit board 11 in order to connect to the signal feeding terminal 113. The second resonance unit 38 is connected to the first resonance unit 35 via the first filtering element 371, and thus the first filtering element 371 is located between the first resonance unit 35 and the second resonance unit 38, wherein part or all of the second resonance unit 38 is disposed on the surface of the substrate 13 or within the substrate 13.

The first resonance unit 35 forms the first resonant frequency f1 of the multi-frequency antenna 30, and the first resonance unit 35, the first filtering element 371, and the second resonance unit 38 jointly form the second resonant frequency f2 of the multi-frequency antenna 30, wherein the frequency of the second resonant frequency f2 is lower than the first resonant frequency f1. Further, the first filtering element 371 shows a high impedance towards the signal with the first resonant frequency f1 to isolate the first resonant frequency signal f1 from the second resonance unit 38. The first filtering element 371 shows a low impedance towards the signal with the second resonant frequency f2, thus the second resonant frequency signal f2 can pass through the first filtering element 371.

In one embodiment of the invention, the first resonance unit 35 comprises a first conducting plane 351, and the second resonance unit 38 comprises a second conducting plane 381 and a rounded conducting plane 382 with curve boundary. For example, the first conducting plane 351 and the second conducting plane 381 may be a square, and the rounded conducting plane 382 may comprise region with curve boundary. The second conducting plane 381 is connected to the rounded conducting plane 382.

In this embodiment of the invention, the first filtering element 371 is disposed on the surface of the substrate 13, and is connected to the first resonance unit 35 and the second resonance unit 38. Thus, the first filtering element 371 is located between the first resonance unit 35 and the second resonance unit 38, as shown in FIG. 5.

Figure 6:
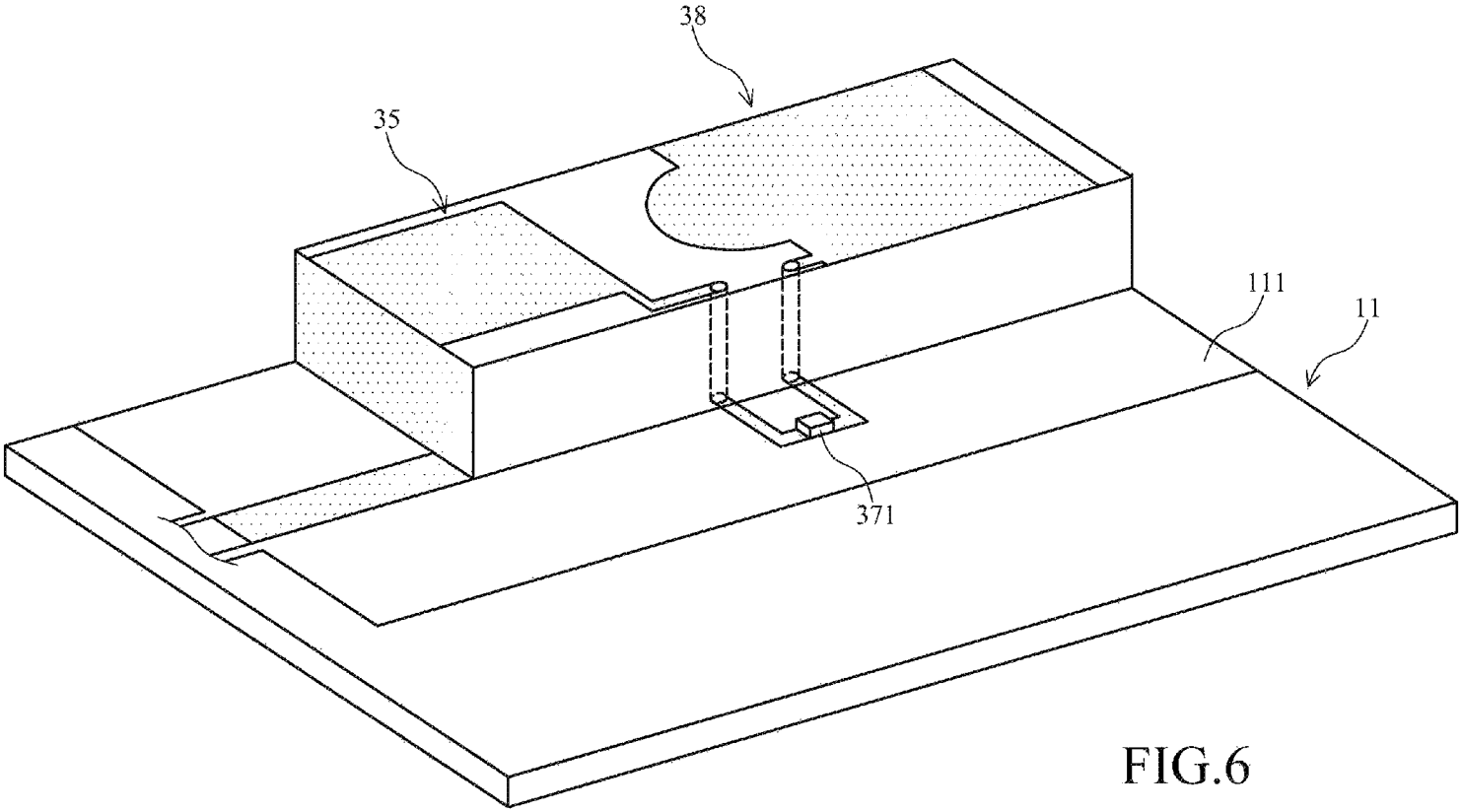
FIG. 6 is a perspective view of a multi-frequency antenna according to another embodiment of the invention.

In another embodiment of the invention, the first filtering element 371 is disposed within the clearance area 111 of the circuit board 11, and the first resonance unit 35 and the second resonance unit 38 are connected to the first filtering element 371 within the clearance area 111 via the conducting wires within the clearance area 111, as shown in FIG. 6.

Figure 7:
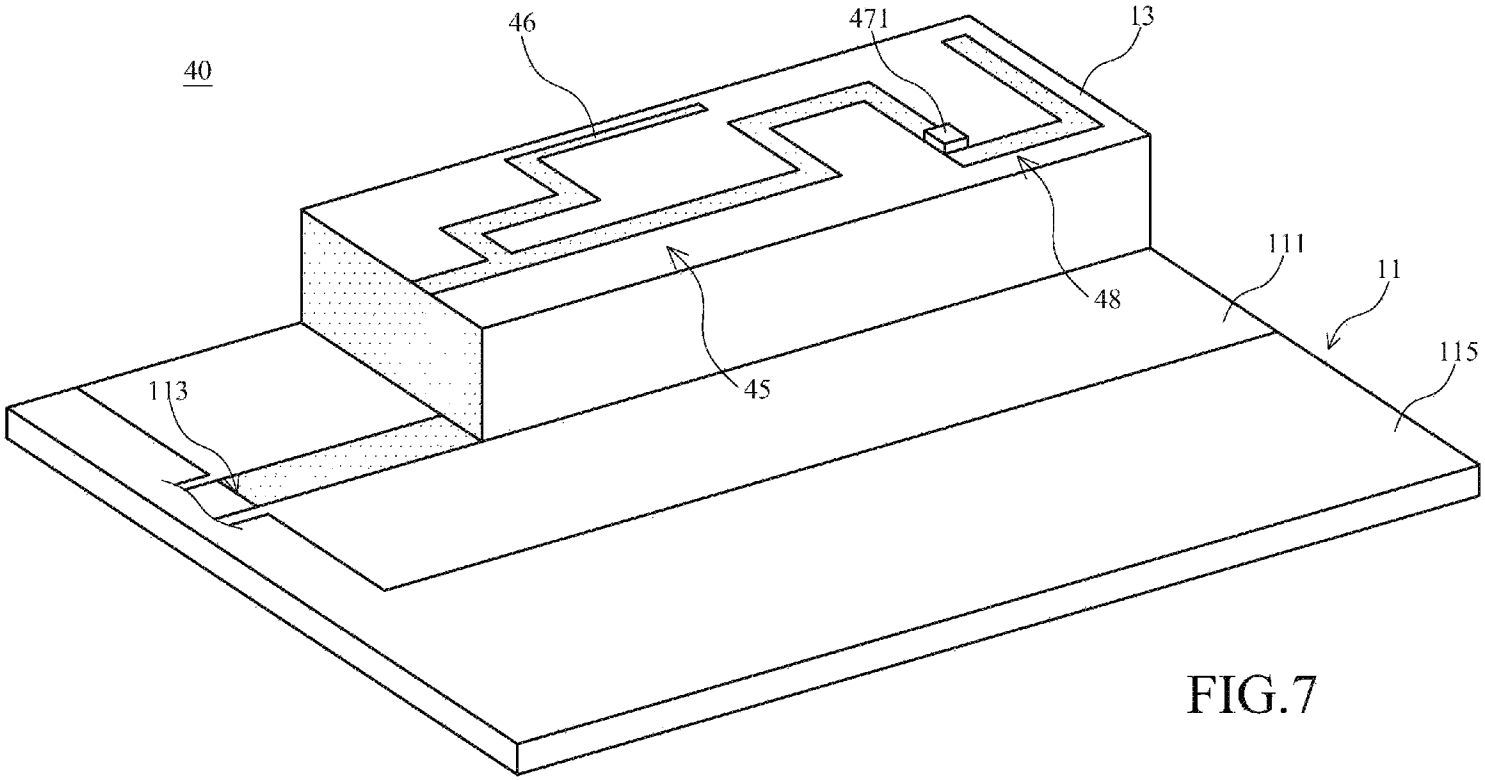
FIG. 7 is a perspective view of a multi-frequency antenna according to another embodiment of the invention.

FIG. 7 is a perspective view of a multi-frequency antenna according to another embodiment of the invention. The multi-frequency antenna 40 comprises a circuit board 11, at least one substrate 13, a first resonance unit 45, a first filtering element 471, and a second resonance unit 48. The circuit board 11 comprises a clearance area 111 and at least one signal feeding terminal 113, and the substrate 13 is disposed within the clearance area 111 of the circuit board 11.

The first resonance unit 45 is connected to the signal feeding terminal 113, and part or all of the first resonance unit 45 is located on the surface of the substrate 13 or within the substrate 13. For example, part of the first resonance unit 45 is disposed on the top surface of the substrate 13, and part of the first resonance unit 45 is extended within the clearance area 111 of the circuit board 11 to connect to the signal feeding terminal 113. The first filtering element 471 is disposed on the surface of the substrate 13, and the second resonance unit 48 is connected to the first resonance unit 45 via the first filtering element 471. Part or all of the second resonance unit 48 is disposed on the surface of the substrate 13, such as the top surface, or within the substrate 13.

Figure 8:
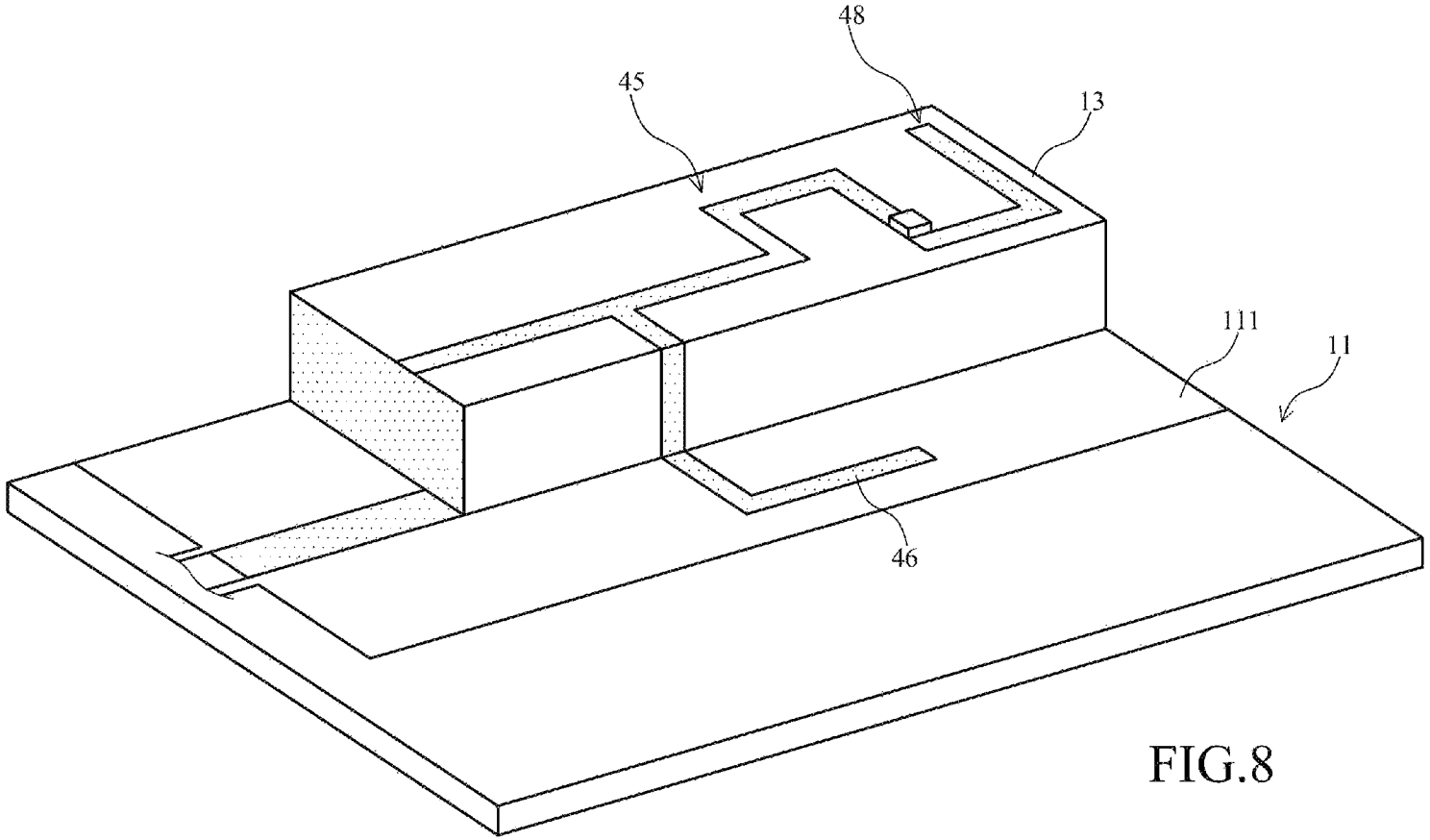
FIG. 8 is a perspective view of a multi-frequency antenna according to another embodiment of the invention.

In one embodiment of the invention, the multi-frequency antenna 40 comprises at least one extended unit 46 disposed on the surface of the substrate 13 or within the substrate 13. One end of the extended unit 46 is connected to the first resonance unit 45, such as the extended unit 46 disposed on the top surface of the substrate 13, as shown in FIG. 7. In another embodiment, the extended unit 46 may be extended to the clearance area 111 of the circuit board 11. For example, one end of the extended unit 46 is connected to the first resonance unit 45. Part of the extended unit 46 is disposed on the surface or the top surface of the substrate 13, and part of the extended unit 46 is extended to the clearance area 111 via the side surface of the substrate 13, as shown in FIG. 8.

Figure 9:
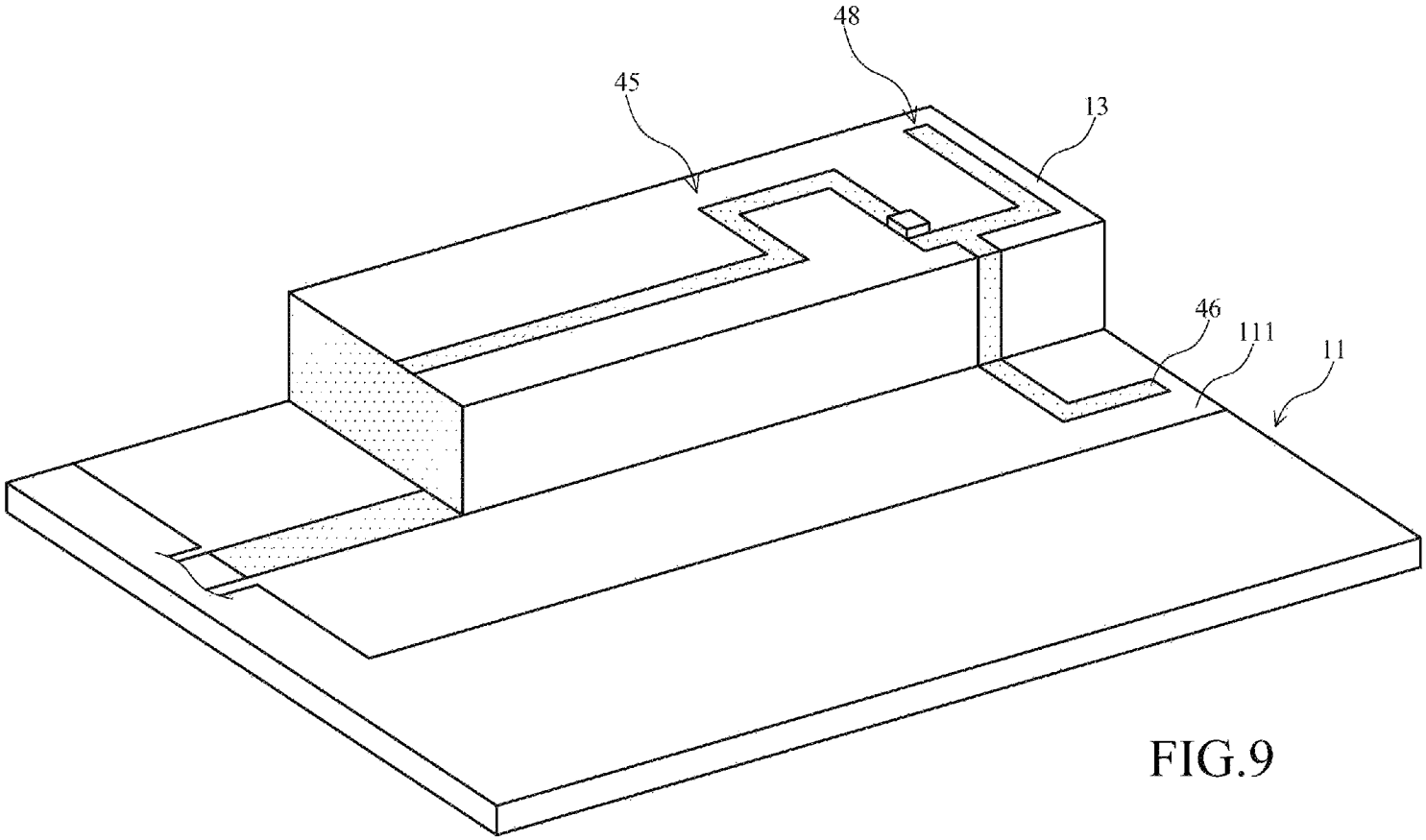
FIG. 9 is a perspective view of a multi-frequency antenna according to another embodiment of the invention.

In another embodiment of the invention, the extended unit 46 may be connected to the second resonance unit 48, wherein the extended unit 46 is disposed on the surface of the substrate 13 or within the substrate 13, or is extended to the clearance area 111 of the circuit board 11. For example, one end of the extended unit 46 is connected to the second resonance unit 48. Part of the extended unit 46 is disposed on the surface of the substrate 13 or within the substrate 13, and part of the extended unit 46 is extended to the clearance area 111 via the side surface of the substrate 13, as shown in FIG. 9.

Figure 10:
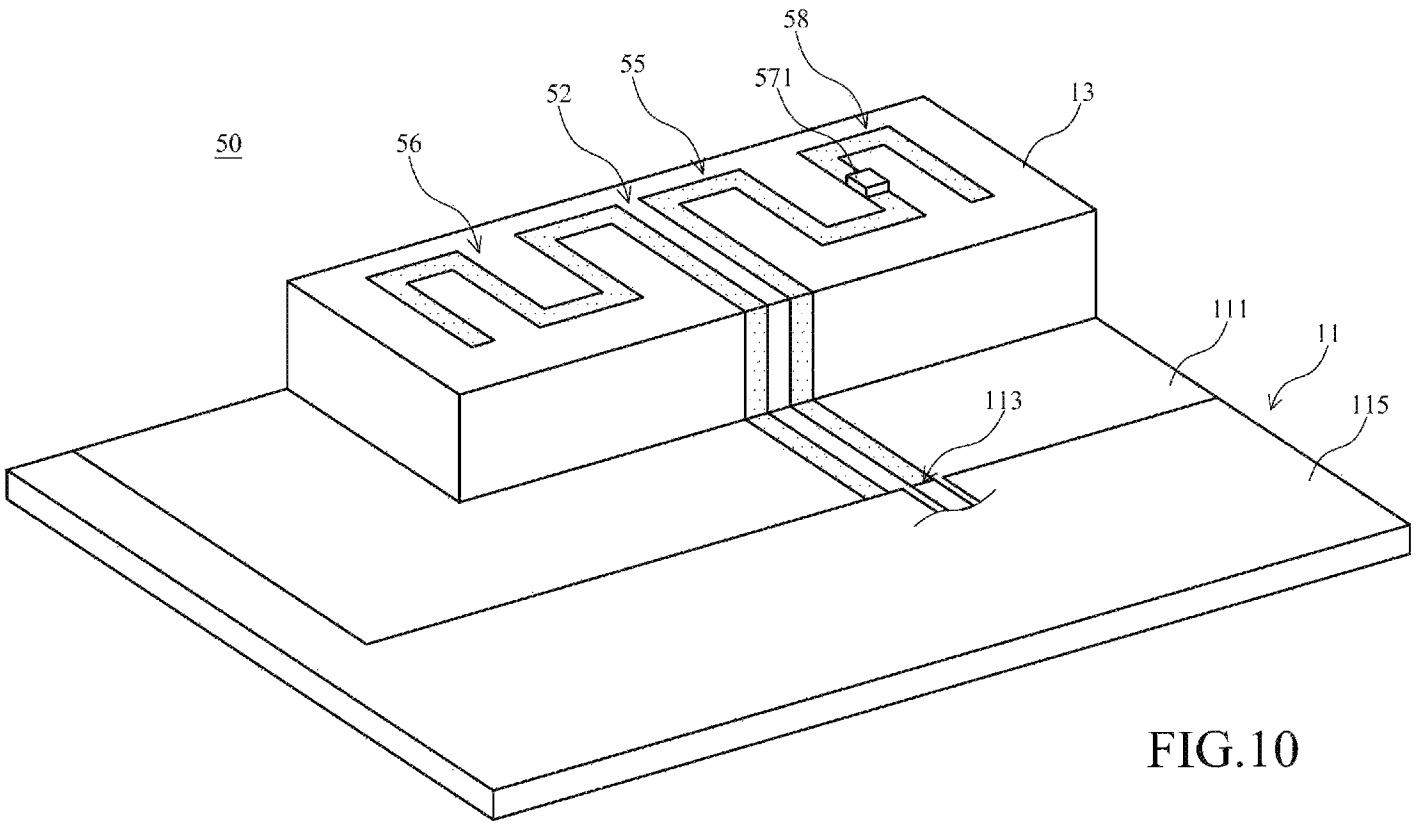
FIG. 10 is a perspective view of a multi-frequency antenna according to another embodiment of the invention.

FIG. 10 is a perspective view of a multi-frequency antenna according to another embodiment of the invention. The multi-frequency antenna 50 comprises a circuit board 11, at least one substrate 13, a first resonance unit 55, a first filtering element 571, a second resonance unit 58, and a coupling unit 56. The circuit board 11 comprises a clearance area 111 and at least one signal feeding terminal 113, and the substrate 13 is disposed within the clearance area 111 of the circuit board 11.

The first resonance unit 55 is connected to the signal feeding terminal 113, and part or all of the first resonance unit 55 is located on the surface of the substrate 13 or within the substrate 13. For example, part of the first resonance unit 55 is disposed on the top surface or the side surface of the substrate 13, and part of the first resonance unit 55 is disposed within the clearance area 111 of the circuit board 11 to connect to the signal feeding terminal 113. The first filtering element 571 is disposed on the surface of the substrate 13, and the second resonance unit 58 is connected to the first resonance unit 55 via the first filtering element 571. Part or all of the second resonance unit 58 is disposed on the surface of the substrate 13 or within the substrate 13, such as the second resonance unit 58 being disposed on the top surface of the substrate 13.

In one embodiment of the invention, the coupling unit 56 of the multi-frequency antenna 50 is disposed on the surface of the substrate 13 or within the substrate 13. A portion of the first resonance unit 55 is adjacent to partial portion of the coupling unit 56 to form a gap 52 therebetween. For example, part of the coupling unit 56 is disposed on the top surface and/or side surface of the substrate 13, and part of the coupling unit 56 is disposed within the clearance area 111. In another embodiment, one end of the coupling unit 56 is connected to the ground layer 115 of the circuit board 11. Further, the shape of the coupling unit 56 may be similar to the shapes of the first resonance unit 55 and the second resonance unit 58. However, this is one embodiment of the invention and is not a limitation of the invention. In another embodiment, the coupling unit 56 may not be connected to the ground layer 115, and the shape of the coupling unit 56 may not be similar to the shape of the first and second resonance unit 55/58.

Figure 11:
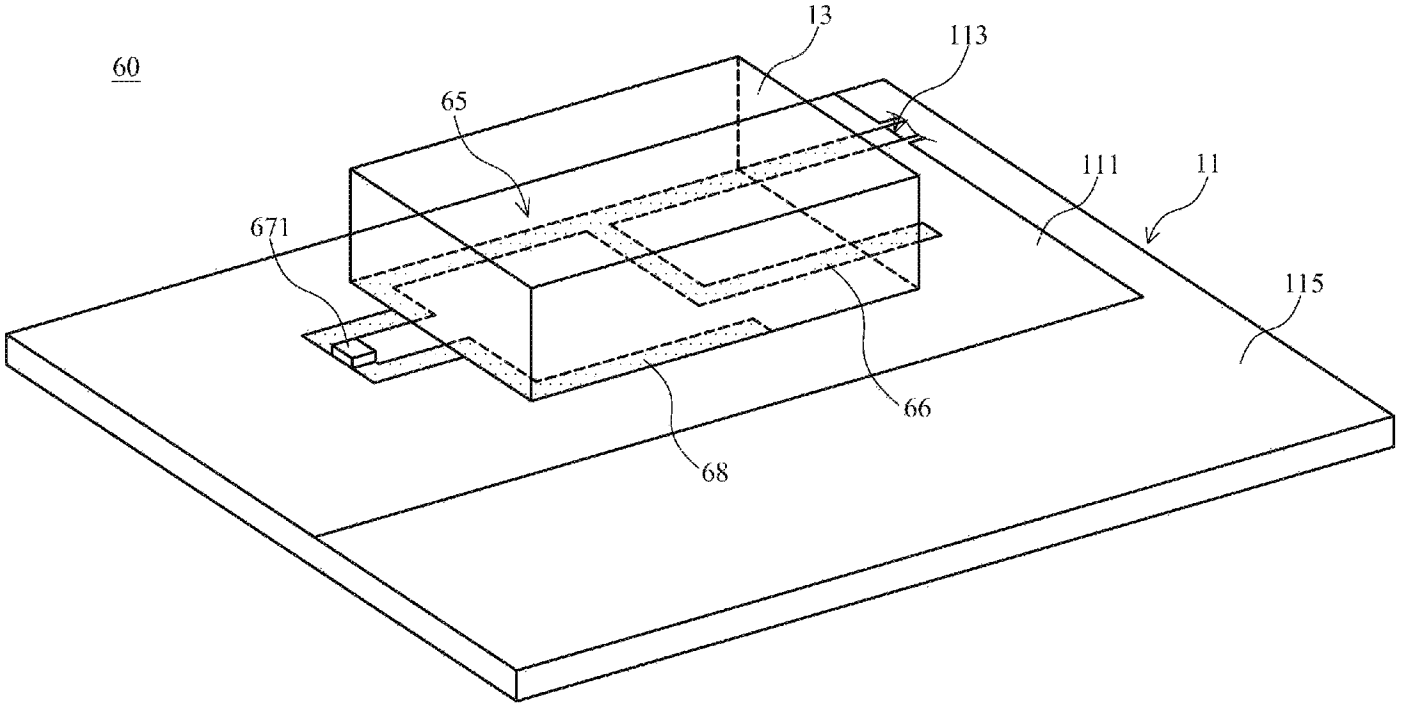
FIG. 11 is a perspective view of a multi-frequency antenna according to another embodiment of the invention.

FIG. 11 is a perspective view of a multi-frequency antenna according to another embodiment of the invention. The multi-frequency antenna 60 comprises a circuit board 11, at least one substrate 13, a first resonance unit 65, a first filtering element 671, and a second resonance unit 68. The circuit board 11 comprises a clearance area 111 and at least one signal feeding terminal 113, and the substrate 13 is disposed within the clearance area 111 of the circuit board 11.

In one embodiment of the invention, the first resonance unit 65 is connected to the signal feeding terminal 113, and part or all of the first resonance unit 65 is located on the surface of the substrate 13 or within the substrate 13. For example, part of the first resonance unit 65 is disposed on the bottom surface of the substrate 13, and part of the first resonance unit 65 is extended to the clearance area 111 of the circuit board 11 to connect to the signal feeding terminal 113. The first filtering element 671 is disposed within the clearance area 111 of the circuit board 11, and the second resonance unit 68 is connected to the first resonance unit 65 via the first filtering element 671. Part or all of the second resonance unit 68 is disposed on the surface of the substrate 13 or within the substrate 13, such as the second resonance unit 68 being disposed on the bottom surface of the substrate 13.

In one embodiment of the invention, the multi-frequency antenna 60 further comprises at least one extended unit 66, and one end of the extended unit 66 is connected to the first resonance unit 65. Part of the extended unit 66 is disposed on the surface of the substrate 13, and part of the extended unit 66 is extended to the clearance area 111. For example, part of the extended unit 66 is disposed on the bottom surface of the substrate 13, and part of the extended unit 66 is extended to the clearance area 111, as shown in FIG. 11. In another embodiment, instead of connecting to the first resonance unit 65, the extended unit 66 may be connected to the second resonance unit 68.

Figure 12:
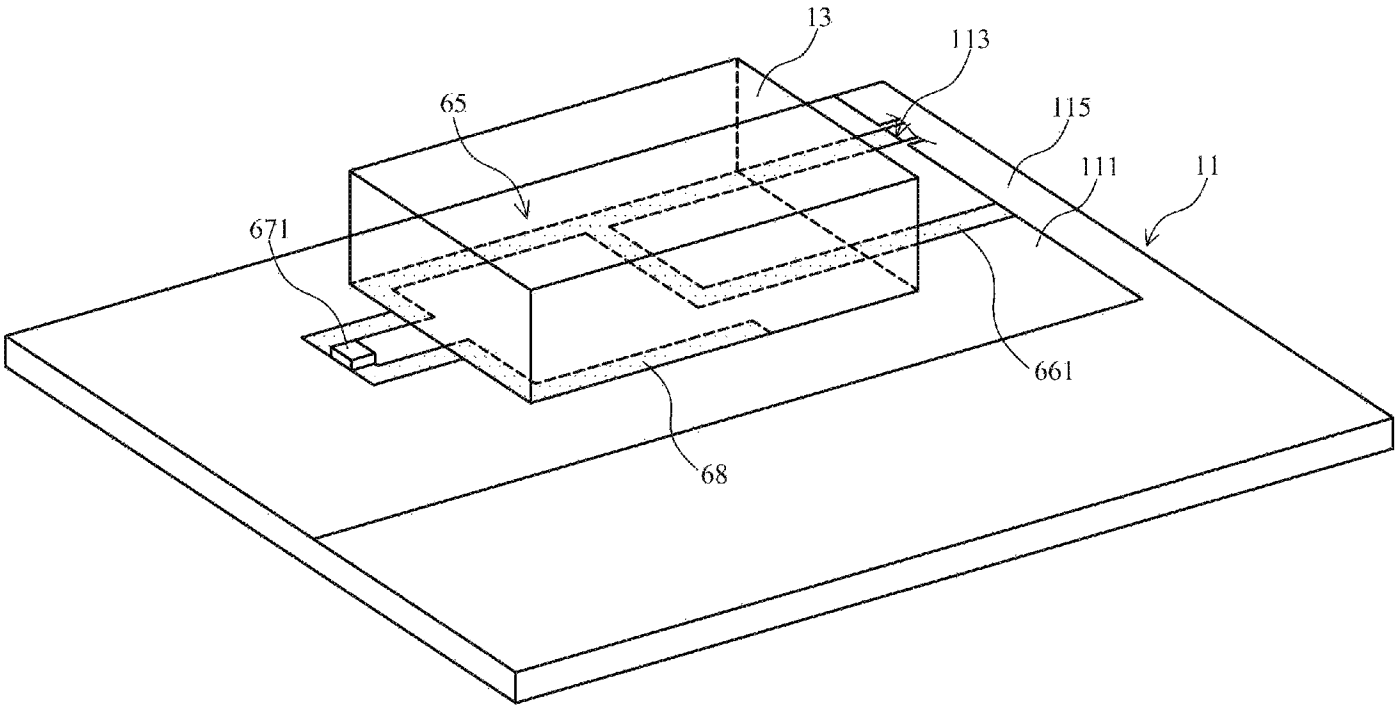
FIG. 12 is a perspective view of a multi-frequency antenna according to another embodiment of the invention.

In another embodiment of the invention, the circuit board 11 further comprises a ground layer 115, and the extended unit 66 shown in FIG. 11 may be connected to the ground layer 115 via a ground wire 661. The ground wire 661 is able to connect to the first resonance unit 65 and the ground layer 115, as shown in FIG. 12. In another embodiment, instead of connecting to the first resonance unit 65, the ground wire 661 may be connected to the second resonance unit 68 and the ground layer 115.

Figure 13:
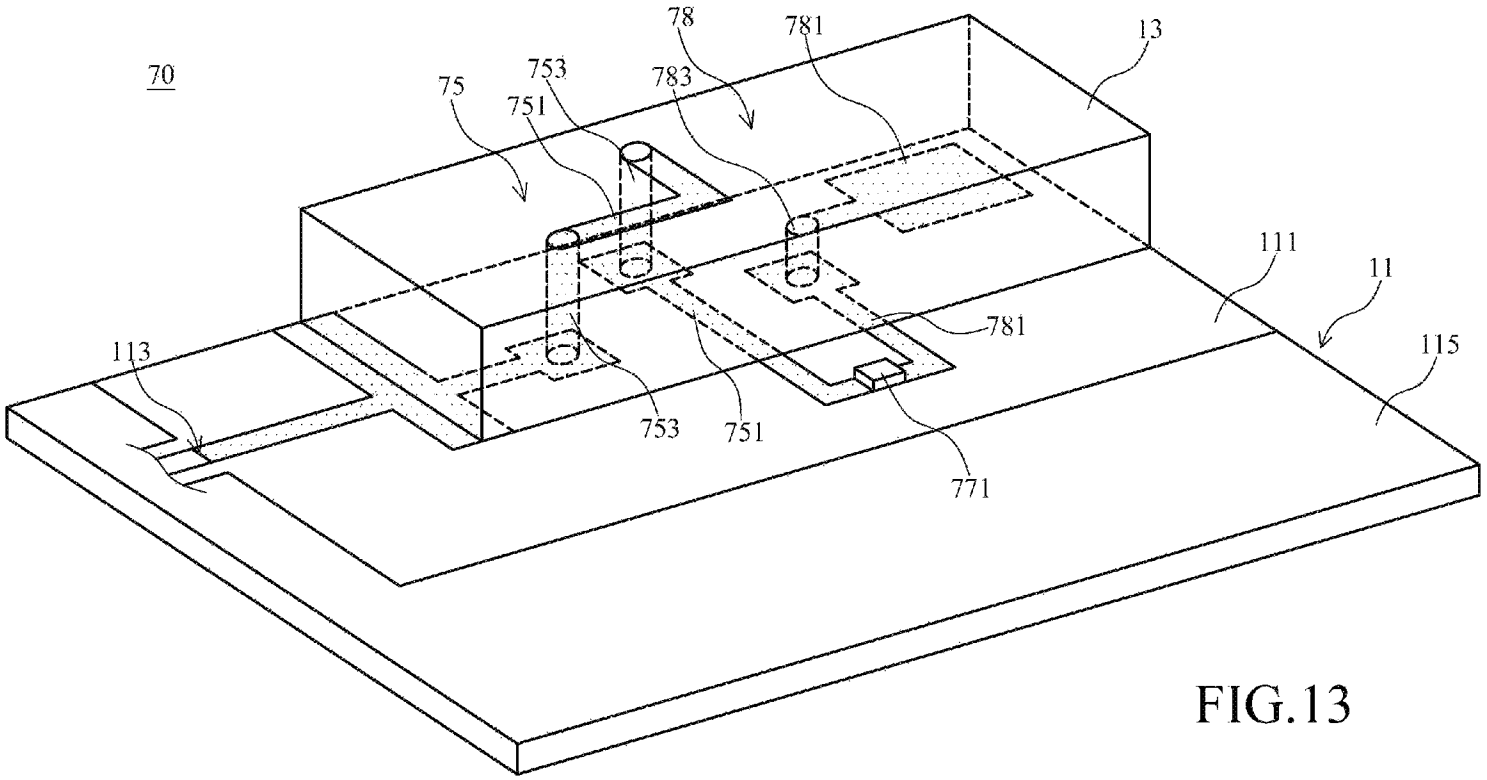
FIG. 13 is a perspective view of a multi-frequency antenna according to another embodiment of the invention.

FIG. 13 is a perspective view of a multi-frequency antenna according to another embodiment of the invention. The multi-frequency antenna 70 comprises a circuit board 11, at least one substrate 13, a first resonance unit 75, a first filtering element 771, and a second resonance unit 78. The circuit board 11 comprises a clearance area 111 and at least one signal feeding terminal 113, and the substrate 13 is disposed within the clearance area 111 of the circuit board 11.

One end of the first resonance unit 75 is connected to the signal feeding terminal 113, and the other end of the first resonance unit 75 is connected to the first filtering element 771. The second resonance unit 78 is connected to the first resonance unit 75 via the first filtering element 771, thus the first filtering element 771 is located between the first resonance unit 75 and the second resonance unit 78.

In this embodiment of the invention, the first resonance unit 75 comprises a plurality of first conducting layers 751 and at least one first connecting unit 753. Each first conducting layer 751 may be disposed on different planes or surfaces of the substrate 13, and the first connecting unit 753 penetrates through part or all of the substrate 13 in order to connect with the first conducting layers 751 disposed on different planes or surfaces of the substrate 13. For example, part of the first conducting layer 751 is disposed on the bottom surface of the substrate 13, and part of the first conducting layer 751 is disposed on the top surface of the substrate 13. Further, the first conducting layers 751 disposed on the top surface and the bottom surface of the substrate 13 are connected to each other via the first connecting unit 753.

Furthermore, the second resonance unit 78 comprises a plurality of second conducting layer 781 and at least one second connecting unit 783. Each second conducting layer 781 is disposed on different planes or surfaces of the substrate 13 respectively, and the second connecting unit 783 penetrates through part or all of the substrate 13 and is connected to the second conducting layers 781 disposed on different planes or surfaces of the substrate 13. For example, part of the second conducting layer 781 is disposed on the bottom surface of the substrate 13, and part of the second conducting layer 781 is disposed within the substrate 13. Further, the second conducting layers 781 disposed on the bottom surface of the substrate 13 and within the substrate 13 are connected to each other via the second connecting unit 783.

Figure 14:
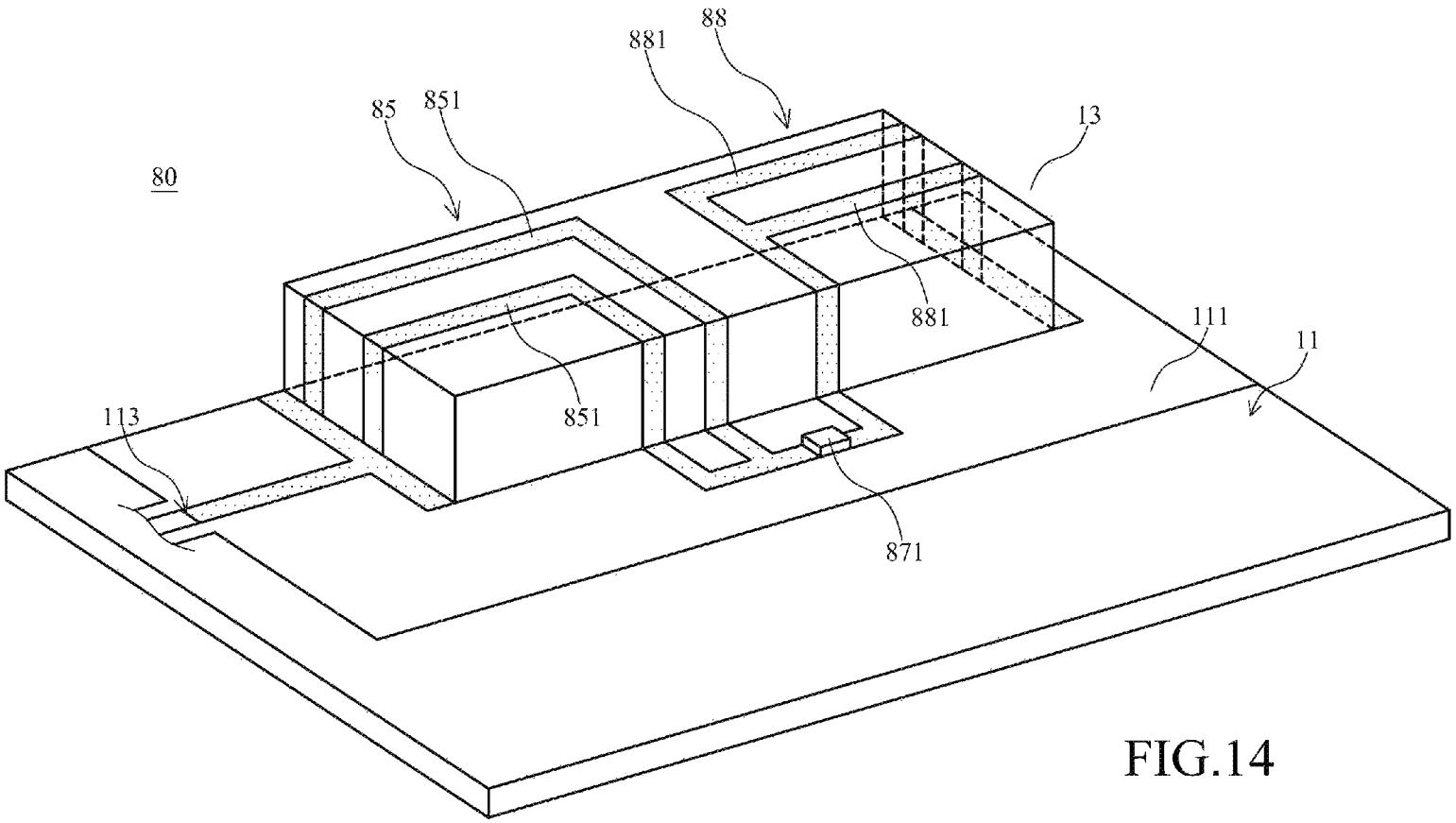
FIG. 14 is a perspective view of a multi-frequency antenna according to another embodiment of the invention.

FIG. 14 is a perspective view of a multi-frequency antenna according to another embodiment of the invention. The multi-frequency antenna 80 comprises a circuit board 11, at least one substrate 13, a first resonance unit 85, a first filtering element 871, and a second resonance unit 88. The circuit board 11 comprises a clearance area 111 and at least one signal feeding terminal 113, and the substrate 13 is disposed within the clearance area 111 of the circuit board 11. The first filtering element 871 can be disposed on the surface of substrate 13 or in the clearance area 111 of the circuit board 11.

In this embodiment of the invention, the first resonance unit 85 comprises a plurality of first conducting wires 851, and part or all of the first resonance unit 85 is disposed on the surface of the substrate 13 or within the substrate 13. For example, part of the first resonance unit 85 is disposed on the top surface of the substrate 13, and part of the first resonance unit 85 is extended to the clearance area 111 via the side surface of the substrate 13. One end of each first conducting wire 851 can be connected to the signal feeding terminal 113, and the other end of each first conducting wire 851 can be connected to the first filtering element 871. Further, the second resonance unit 88 comprises a plurality of second conducting wires 881. One end of each second conducting wire 881 can be connected to the first filtering element 871, and the other end of each second conducting wire 881 can or cannot be connected to each other. Furthermore, part or all of the second resonance unit 88 is disposed on the surface of the substrate 13 or within the substrate 13. For example, part of the second resonance unit 88 is disposed on the top surface of the substrate 13, and part of the second resonance unit 88 is extended to the clearance area 111 via the side surface of the substrate 13.

The first resonance units 15/35/45/55/65/75/85, the second resonance units 18/38/48/58/68/78/88, and/or the third resonance unit 29 described in the invention can be disposed on any surface of the substrate 13, such as on the top surface, the bottom surface, or the side surface of the substrate, or within the substrate 13.

The above disclosures are only the preferred embodiments of the present invention, and are not to be used to limit the scope of the present invention. All equivalent variations and modifications on the basis of shapes, structures, features, and spirits described in the claims of the present invention should be included in the claims of the present invention.

What is claimed is:

1. A multi-frequency antenna comprising:

a circuit board, comprising a ground layer, a clearance area and at least one signal feeding terminal;

at least one substrate disposed within said clearance area;

a first resonance unit connected to said signal feeding terminal, wherein part or all of said first resonance unit is disposed on a surface of said substrate or within said substrate;

a first filtering element connected to said first resonance unit; and a second resonance unit connected to said first filtering element, and thus said first filtering element is disposed between said first resonance unit and said second resonance unit, wherein part or all of said second resonance unit is disposed on said surface of said substrate or within said substrate, wherein said first resonance unit forms a first resonant frequency of said multi-frequency antenna, and said first resonance unit, said first filtering element and said second resonance unit jointly form a second resonant frequency of said multi-frequency antenna, wherein said first filtering element shows a high impedance towards a signal with said first resonant frequency to isolate said first resonant frequency signal from said second resonance unit, wherein said first filtering element shows a low impedance towards a signal with said second resonant frequency, and said second resonant frequency signal is capable of passing through said first filtering element, wherein said second resonant frequency is lower than said first resonant frequency, and said second resonant frequency is independent of said first resonant frequency, wherein there is no any switch between said first resonance unit, said first filtering element, said second resonance unit and said ground layer.

2. The multi-frequency antenna of claim 1, wherein said first resonance unit and said second resonance unit comprise a plurality of conducting segments, and said conducting segment comprises a conducting wire, a connecting unit, a conducting plane, or a curved conducting surface, wherein said conducting wire, said conducting plane, or said curved conducting surface is disposed on said surface of said substrate or within said substrate or within said clearance area, and the connecting unit penetrates through part or all of the substrate to connect with said conducting wire, said conducting plane, or said curved conducting surface.

3. The multi-frequency antenna of claim 1, wherein said first filtering element is disposed on the surface of said substrate or within said substrate or within said clearance area.

4. The multi-frequency antenna of claim 1, wherein said first resonance unit comprises a plurality of first conducting layers disposed on different planes of said substrate, and at least one first connecting unit connecting said first conducting layers, wherein said second resonance unit comprises a plurality of second conducting layers disposed on different planes of said substrate, and at least one second connecting unit connecting said second conducting layers.

5. The multi-frequency antenna of claim 1, further comprising at least one extended unit disposed within said clearance area and electrically connected to said first resonance unit or said second resonance unit.

6. The multi-frequency antenna of claim 1, further comprising at least one extended unit disposed on the surface of said substrate or within said substrate and electrically connected to said first resonance unit or said second resonance unit.

7. The multi-frequency antenna of claim 1, further comprising at least one ground wire connecting said ground layer with said first resonance unit or said second resonance unit.

8. The multi-frequency antenna of claim 7, wherein said first filtering element comprises at least one inductor or a resonant circuit inductors and capacitors.

9. The multi-frequency antenna of claim 1, further comprising a coupling unit disposed on said surface of said substrate or within said substrate, wherein a gap is formed between part or all of said coupling unit and part or all of said first resonance unit or said second resonance unit to form a coupling effect.

10. The multi-frequency antenna of claim 1, wherein said second resonance unit is not connected to said ground layer.

11. A multi-frequency antenna comprising:

a circuit board, comprising a clearance area and at least one signal feeding terminal;

at least one substrate disposed within said clearance area;

a first resonance unit connected to said signal feeding terminal, wherein part or all of said first resonance unit is disposed on a surface of said substrate or within said substrate;

a first filtering element connected to said first resonance unit;

a second resonance unit connected to said first filtering element, and thus said first filtering element is disposed between said first resonance unit and said second resonance unit, wherein part or all of said second resonance unit is disposed on said surface of said substrate or within said substrate, wherein said first resonance unit forms a first resonant frequency of said multi-frequency antenna, and said first resonance unit, said first filtering element and said second resonance unit jointly form a second resonant frequency of said multi-frequency antenna, wherein said first filtering element shows a high impedance towards a signal with said first resonant frequency to isolate said first resonant frequency signal from said second resonance unit, wherein said first filtering element shows a low impedance towards a signal with said second resonant frequency, and said second resonant frequency signal is capable of passing through said first filtering element, wherein said second resonant frequency is lower than said first resonant frequency;

a second filtering element connected to said second resonance unit; and a third resonance unit connected to said second filtering element, and thus said second filtering element disposed between said second resonance unit and said third resonance unit, wherein part or all of said third resonance unit is disposed on said surface of said substrate or within said substrate, wherein said first resonance unit, said first filtering element, said second resonance unit, said second filtering element, and said third resonance unit jointly form a third resonant frequency of said multi-frequency antenna, wherein said second filtering element shows a high impedance towards the signal with said second resonant frequency to isolate said second resonant frequency signal from said third resonance unit, wherein said second filtering element shows a low impedance towards signal with said third resonant frequency, and said third resonant frequency signal is capable of passing through said second filtering element, wherein said third resonant frequency is lower than said second resonant frequency.

12. The multi-frequency antenna of claim 11, wherein said second filtering element is disposed on said surface of said substrate or within said substrate or within said clearance area.

* * * * *